US009949517B2

(12) United States Patent
Howard

(10) Patent No.: US 9,949,517 B2
(45) Date of Patent: Apr. 24, 2018

(54) MEDICAL FACE SHIELD

(71) Applicant: Encompass Group, LLC, McDonough, GA (US)

(72) Inventor: Edward Ray Howard, Dallas, TX (US)

(73) Assignee: Encompass Group, LLC, McDonough, GA (US)

( * ) Notice: Subject to any disclaimer, the term of this patent is extended or adjusted under 35 U.S.C. 154(b) by 0 days.

(21) Appl. No.: 15/013,478

(22) Filed: Feb. 2, 2016

(65) Prior Publication Data

US 2016/0143378 A1 May 26, 2016

Related U.S. Application Data

(63) Continuation-in-part of application No. 14/079,476, filed on Nov. 13, 2013, now abandoned.

(51) Int. Cl.
*A41D 13/11* (2006.01)

(52) U.S. Cl.
CPC ..... *A41D 13/1184* (2013.01); *A41D 13/1161* (2013.01)

(58) Field of Classification Search
CPC .. A61F 9/02; A61F 9/064; A61F 9/029; A61F 9/022; A61F 9/045; A41D 13/1184; A41D 13/11; A41D 13/1153; A62B 18/02; A62B 17/04; A42B 1/043; A42B 1/046; A42B 3/26; Y10S 2/901
USPC .. 2/9, 206, 15, 424, 427, 432, 434, 12, 173, 2/410, 8.5; 128/857, 201.15, 201.12, 128/206.19, 206.21, 206.24
See application file for complete search history.

(56) References Cited

U.S. PATENT DOCUMENTS 1,582,164 A * 4/1926 Burstyn ..... A41D 13/1184 128/863
2,060,127 A * 11/1936 Schofield ..... G02C 7/16 2/12
2,342,377 A * 2/1944 Small ..... G02C 7/16 2/12
2,510,539 A * 6/1950 Arbenz ..... G02C 9/02 2/432
2,861,496 A * 11/1958 Thornton ..... G02C 7/16 2/13
2,978,709 A * 4/1961 Atha ..... A61F 9/064 2/427
3,092,838 A * 6/1963 Vacha ..... G02C 7/16 2/12
3,498,293 A * 3/1970 Oppenheimer ..... A61B 3/02 351/158
3,868,727 A * 3/1975 Paschall ..... A61F 9/064 2/12
4,152,846 A * 5/1979 Witt ..... G02F 1/13306 2/432

(Continued)

*Primary Examiner* — Bobby Muromoto, Jr.
(74) *Attorney, Agent, or Firm* — Baker Donelson; Dorian B. Kennedy

(57) ABSTRACT

A medical face shield (10) is disclosed having a flexible front plate or shield (11), a foam forehead pad (21), and a flexible, stretchable headband (22). The front shield has a viewing window (25) which is positioned to be directly in front of a person's eyes wearing the face shield. The viewing window is surrounded by a translucent, peripheral margin, frame, or window surrounding portion (27) which provides an anti-glare characteristic or capability to the margin.

13 Claims, 1 Drawing Sheet

(56) References Cited

U.S. PATENT DOCUMENTS 4,617,686 A * 10/1986 Nahas ..... A61F 9/025 2/433
4,637,678 A * 1/1987 Moss ..... A61F 9/022 359/15
4,755,023 A * 7/1988 Evans ..... A42B 3/042 2/424
4,805,639 A * 2/1989 Dial ..... A41D 13/11 128/857
4,839,924 A * 6/1989 Laurence ..... A42B 1/247 2/12
4,945,574 A * 8/1990 Dagher ..... A61F 9/02 128/201.12
5,099,525 A * 3/1992 Millauro ..... A41D 13/1115 128/206.19
5,235,441 A * 8/1993 Georgaras ..... A61F 9/022 351/159.01
5,355,182 A * 10/1994 Barbera ..... A61F 9/022 351/159.48
5,440,760 A * 8/1995 Highsmith ..... A41D 13/11 128/857
5,546,099 A * 8/1996 Quint ..... G02B 27/0172 128/857
5,732,410 A * 3/1998 Machson ..... A61F 9/02 128/857
6,141,797 A * 11/2000 Buck ..... A61F 9/029 128/858
6,237,147 B1 * 5/2001 Brockman ..... A42B 1/247 2/10
6,275,998 B1 * 8/2001 Tromble ..... A61F 9/04 2/15
6,384,991 B1 * 5/2002 Brown ..... A61F 9/029 359/813
7,322,693 B2 * 1/2008 Abraham ..... A61F 9/045 2/15
7,540,039 B2 * 6/2009 Reaux ..... A41D 13/1184 128/201.15
7,708,402 B2 * 5/2010 Ribak ..... A61F 9/022 351/159.02
7,725,949 B2 * 6/2010 Landis ..... A61F 9/022 2/206
7,740,352 B2 * 6/2010 Kopren ..... A61H 5/00 351/45
7,937,775 B2 * 5/2011 Manzella, Jr. ..... A41D 13/0025 128/201.22
8,261,375 B1 * 9/2012 Reaux ..... A42B 1/043 128/201.15
2005/0206841 A1 * 9/2005 Saderholm ..... A61F 9/02 351/159.08
2005/0225868 A1 * 10/2005 Nelson ..... A63B 33/002 359/630
2006/0143766 A1 * 7/2006 Ramsey ..... A61F 9/02 2/15
2006/0277664 A1 * 12/2006 Akhtar ..... A42B 3/06 2/410
2007/0109492 A1 * 5/2007 Abraham ..... A61F 9/045 351/45
2007/0221214 A1 * 9/2007 Brockman ..... A62B 17/04 128/201.25
2008/0218685 A1 * 9/2008 Ribak ..... A61F 9/022 351/159.02
2008/0231795 A1 * 9/2008 Cartier ..... C08J 7/065 351/49
2009/0066907 A1 * 3/2009 Kopren ..... A61H 5/00 351/45
2009/0290120 A1 * 11/2009 Abraham ..... A61F 9/045 351/158
2012/0102622 A1 * 5/2012 Rodriguez ..... A41G 7/00 2/206
2013/0242262 A1 * 9/2013 Lewis ..... G02B 27/0093 351/209
2013/0247286 A1 * 9/2013 VanderWoude ... A41D 13/0025 2/424
2014/0016084 A1 * 1/2014 Bowers ..... G02C 7/046 351/159.31
2014/0168598 A1 * 6/2014 Spitzer ..... G02C 11/00 351/62
2014/0204335 A1 * 7/2014 Ur ..... G02C 7/027 351/159.06

* cited by examiner

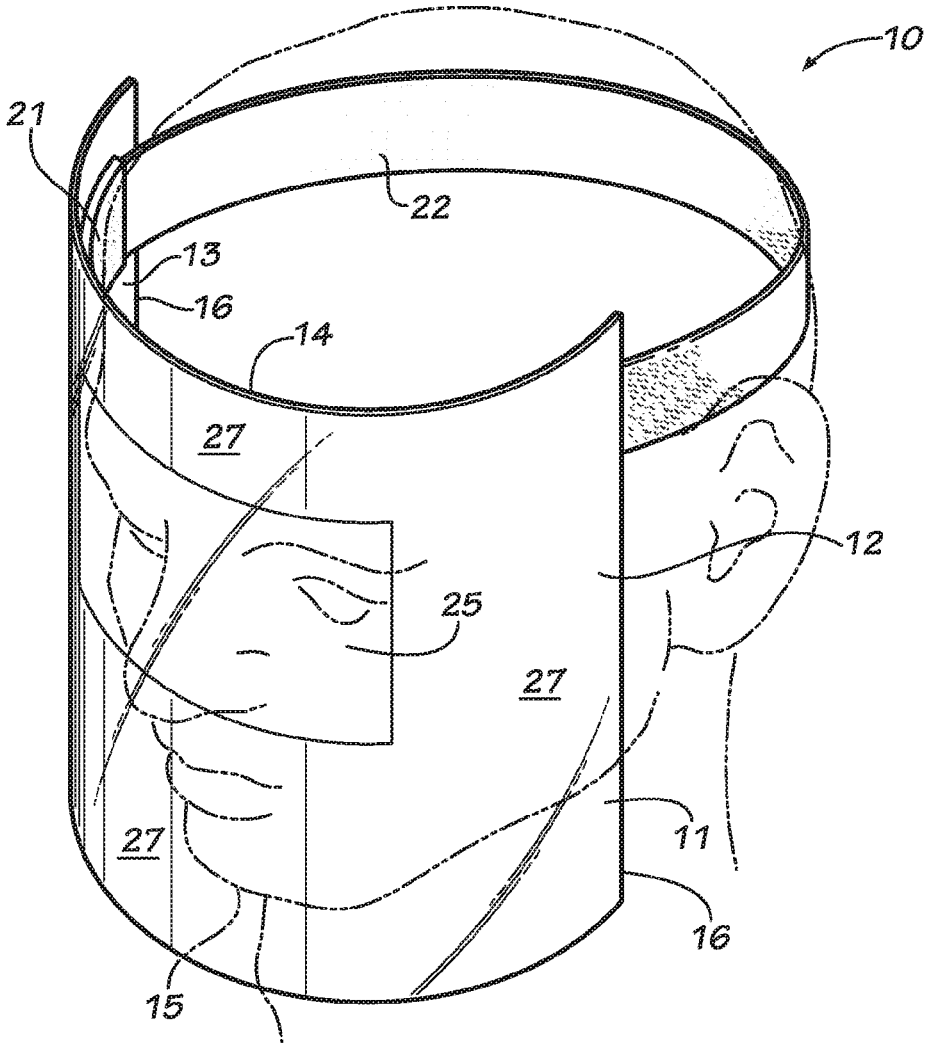
10
21
22
13
16
14
27
12
25
27
27
11
16
15

MEDICAL FACE SHIELD

REFERENCE TO RELATED APPLICATION

This application is a continuation-in-part of U.S. patent application Ser. No. 14/079,476 filed on Nov. 13, 2013.

TECHNICAL FIELD

This invention relates generally to a shield worn over the face, and more particularly to shields worn over the face during a medical procedure.

BACKGROUND OF THE INVENTION

Medical professionals oftentimes must wear masks or shields to protect themselves from fluids and other contaminants from a patient. These shields are typically in the form of a large clear sheet of plastic that is positioned in front of the face. While these shields provide a great deal of protection, a problem related to the use of the shield is that they also produce a glare from the bright lights of an operating room, or the like, which can impair the vision of the medical professional. Another problem associated with such shields is also that they provide unobstructed vision within the medical professional's field of view, which may include distractions away from the immediate task at hand. Lastly, these shields must be made to be extremely light as a surgeon or other medical personnel must wear them for extended periods of time, requiring them to be comfortable during the entire period of time of use.

Accordingly, it is seen that a need remains for a medical face shield which can aid in reducing glare but also increase the focus of the medical professional to the immediate task. It is to the provision of such therefore that the present invention is primarily directed.

SUMMARY OF THE INVENTION

In a preferred form of the invention a medical face shield comprises a flexible shield having a transparent viewing window and a translucent margin surrounding the transparent viewing window, and a flexible headband coupled to the flexible shield.

BRIEF DESCRIPTION OF THE DRAWING

FIG. 1 is a perspective view of a medical face shield embodying principles of the invention in a preferred form.

DETAILED DESCRIPTION

With reference next to the drawings, there is shown a medical face shield 10 in a preferred form of the invention. The face shield 10 has a curved, flexible, plastic front plate or shield 11 having a front surface 12, a rear surface 13, a top edge 14, a bottom edge 15, and two oppositely disposed side edges 16. The face shield 10 also includes a soft, pliable, flexible, foam forehead pad 21 which is affixed to the rear surface 13 adjacent the top edge 14, and a flexible, stretchable headband 22 having ends which are affixed to the front shield 11 adjacent the two opposite side edges.

The front shield 11 has an integral viewing window 25 which is positioned to be directly in front of a person's eyes wearing the face shield 10. The viewing window 25 is integrally surrounded by a translucent, peripheral margin, frame, or window surrounding portion 27 which provides an anti-glare characteristic or capability to the margin 27, the margin constituting a majority of the front shield 11. The term integral, integral with, and integrally surrounding or the like is intended to connotes a construction wherein the window is made from one of more layers of material which extends to a surrounding area without interruption, without being joined or coupled through attachment means, or made of different materials or portions of the same material, i.e., the window and surrounding material are made at least in part from the exact same layer of material in a peripherally continuous, co-extending, or generally co-planar manner. This definition does not include a condition or construction wherein one layer, portion, window, or the like is coupled to another portion or the like, such as that shown in U.S. Pat. No. 2,978,709 wherein a window is mounted to a face shield.

The front shield may be constructed of two plies or laminate layers of material wherein one ply is transparent and the other ply has the transparent viewing window and the translucent, anti-glare component, or constructed of one ply having a treated surface to produce the translucent, anti-glare component on the margin 27, or constructed wherein one ply is transparent and the other ply has the translucent, anti-glare component and a cutout wherein material is absent in the area of the viewing window. The treatment of the material to form the translucent component may be applied through a spray, dipping, printing, texturing, lamination, or any other conventionally known manner of applying such a layer or component. The front shield may be made of a polymeric material, such as an acrylic, polypropylene, polycarbonate, or other similar material. The peripheral margin 27 may be a darkened or shaded area, a roughened or otherwise textured area, a shaded area having a pattern of clear portions therein (partially obscured), or any other treatment that produces a partially obscured or obstructed, shaded, or translucent effect to limit the clear vision therethrough, which is described herein, specifically including the claims, collectively as "translucent". The translucent margin is one that is specifically manufactured so as to have a definite and purposeful desired regulated condition or appearance and not one that is produced by mere undesired scratching, marring, damage or other accidental condition with use subsequent to the manufacturing process.

In use, the face shield 10 is donned by a wearer in the usual manner with the forehead pad 21 positioned upon the wearer's forehead and the headband 22 wrapping about the wearer's head in order to maintain the position of the face shield upon the wearer's head. The viewing window 25 is positioned directly in front of a wearer's eyes in order to restrict or allow limited clear viewing of the wearer's field of view. By limiting the viewing to the area directly in front of the wearer the wearer's attention is restricted or limited to that viewing field, thereby limiting distractions occurring outside the limited viewing area. However, the wearer is still aware of the presence of objects outside the viewing window and should the wearer need to see something outside the viewing window the translucent capabilities of the margin 27 allow the wearer to do so. Furthermore, the margin 27 has anti-glare characteristics or capabilities so that the glare from the lights of the operating room, or the like, does not cause a problem or distraction for the wearer. Also, the construction of the present invention provides for a face shield which is light in weight and therefore comfortable for the wearer to don for an extended period of time.

It should be understood that as an alternative to the headband shown in the preferred embodiment, other types of head mounting means, such as arms positioned to be worn upon the ears, a hat like structure, a hood structure, and the like, may also be utilized.

It should be understood that the rectangular shape window shown in the preferred embodiment is a preferred shape. However, the window may be of any shape, such as a square, trapezoid, circle, oval or other shape, and may include rounded corners as well as the sharp corners shown in the drawings.

It thus is seen that a face shield is now provided which reduces glare focuses the wearer's attention to those items within a limited clear field of view and is very light in weight. Although the face shield has been illustrated and described in its preferred form, it should be understood that many modifications, additions and deletions may be made to that specific form without departure from the spirit and scope of the invention as set forth in the following claims.

The invention claimed is:

1. A medical face shield comprising:

a flexible shield having a transparent viewing window and an integral translucent margin integrally extending with and surrounding said transparent viewing window, and a flexible headband coupled to said flexible shield; wherein said flexible shield is a multilayered laminate material which includes a first layer of transparent material and a second layer of material having said transparent viewing window and said translucent margin overlaying said first layer of transparent material.

2. The medical face shield of claim 1 wherein said translucent margin is a darkened margin.

3. The medical face shield of claim 1 wherein said translucent margin is a partially obscured margin.

4. The medical face shield of claim 1 wherein said translucent margin is a darkened and partially obscured margin.

5. The medical face shield of claim 1 further comprising a forehead pad mounted to said flexible shield.

6. The medical face shield of claim 1 wherein said transparent viewing window is rectangular in shape.

7. A medical face shield comprising a front shield having a translucent portion to restrict clear viewing therethrough and a viewing window positioned within and completely surrounded by said translucent portion, said viewing window having a transparent characteristic to allow clear viewing therethrough, said translucent portion being formed of at least one layer of plastic material and said viewing window being integrally and co-extending with said translucent portion, and wherein both the translucent portion and the window are of the same material, and head mount coupled to said medical face shield for mounting the medical face shield upon the head of a wearer.

8. The medical face shield of claim 7 wherein said translucent portion is a darkened margin.

9. The medical face shield of claim 1 wherein said translucent portion is a partially obscured margin.

10. The medical face shield of claim 1 wherein said translucent portion is a darkened and partially obscured margin.

11. The medical face shield of claim 1 further comprising a forehead pad mounted to said front shield.

12. The medical face shield of claim 7 wherein said viewing window is rectangular in shape.

13. The medical face shield of claim 7 wherein said front shield is a multilayered laminate material which includes a first layer of transparent material and a second layer of material having said viewing window and said translucent portion overlaying said first layer of transparent material.

* * * * *